US007205942B2

(12) United States Patent
Wang et al.

(10) Patent No.: US 7,205,942 B2
(45) Date of Patent: Apr. 17, 2007

(54) MULTI-BAND ANTENNA ARRANGEMENT

(75) Inventors: Hanyang Wang, Oxfordshire (GB); Ming Zheng, Hampshire (GB); Sean Brett, Surrey (GB)

(73) Assignee: Nokia Corporation, Espoo (FI)

( * ) Notice: Subject to any disclaimer, the term of this patent is extended or adjusted under 35 U.S.C. 154(b) by 2 days.

(21) Appl. No.: 11/176,628

(22) Filed: Jul. 6, 2005

(65) Prior Publication Data

US 2007/0008222 A1 Jan. 11, 2007

(51) Int. Cl.
*H01Q 1/38* (2006.01)

(52) U.S. Cl. ..... 343/700 MS; 343/702; 343/725; 343/846

(58) Field of Classification Search ..... 343/702, 343/700 MS, 846, 725
See application file for complete search history.

(56) References Cited

U.S. PATENT DOCUMENTS 6,903,690 B2 * 6/2005 Leclerc et al. ..... 343/700 MS
7,075,484 B2 * 7/2006 Sung ..... 343/700 MS
2004/0090376 A1 * 5/2004 Dai et al. ..... 343/700 MS
2004/0090377 A1 5/2004 Dai et al. ..... 343/700
2005/0190108 A1 * 9/2005 Lin et al. ..... 343/702
2005/0264455 A1 * 12/2005 Talvitie et al. ..... 343/702

FOREIGN PATENT DOCUMENTS

EP 1304765 A2 4/2003
EP 1307942 5/2003

* cited by examiner

*Primary Examiner*—Hoang V. Nguyen
(74) *Attorney, Agent, or Firm*—Harrington & Smith, PC

(57) ABSTRACT

An antenna arrangement comprising: a ground plane; a ground point connected to the ground plane; a feed point; a λ/2 antenna element connected to the ground point and to the feed point and extending between the ground point and the feed point as a loop that defines an area; and a λ/4 antenna element located within the area.

32 Claims, 3 Drawing Sheets

MULTI-BAND ANTENNA ARRANGEMENT

FIELD OF THE INVENTION

Embodiments of the present invention relate to a multi-band antenna arrangement.

BACKGROUND TO THE INVENTION

Some radio communication devices communicate in more than one licensed frequency band. For example, a mobile cellular telephone may communicate more than one of the following bands US-GSM (824–894 MHz), E-GSM (880–960 MHz), PCN1800 (1710–1880 MHz), PCS1900 (1850–1990 MHz).

One RF antenna arrangement 10 that enables a radio communication device to communicate in the multiple bands is illustrated in FIG. 1.

The antenna arrangement 10 comprises: a feed point 12; a ground (short-circuit) point 14 connected to a ground plane 16; a first planar antenna element 21 extends between the feed point 12 and the ground point 14 to form a first loop antenna 31 of electrical length L1'; and a second planar antenna element 22 extends between the feed point 12 and the ground point 14 to form a second loop antenna 32 of electrical length L2'.

The ground plane 16 may be a printed wiring board (PWB). In this example it is rectangular having a width W and a length L. The ground plane 16 is parallel to the first and second planar elements 21, 22 but is displaced from them so that the first and second planar elements 21, 22 lie in a plane that is separated from the ground plane 16 by a distance H.

To save space the second planar antenna element 22 lies inside the area circumscribed by the first planar antenna 21. That is the first loop antenna 31 surrounds the second loop antenna 32. This is particularly useful when the antenna arrangement 10 is used internally in a hand-portable radio communication device, such as a mobile cellular telephone.

The first loop antenna 31 has a lowest resonant mode at a frequency corresponding to $\lambda/2$=L1' and a second lowest resonant mode at a frequency corresponding to $\lambda$=L1'. The second loop antenna 32 has a lowest resonant mode at a frequency corresponding to $\lambda/2$=L2'.

The bandwidth of the lowest resonant mode of the first loop antenna 31 may be tuned by varying L and H. The lowest resonant mode of the first loop antenna 31 may be used either for one of the US-GSM and E-GSM bands or, if the bandwidth is tuned to a large value, by optimizing L and H, for both the US-GSM and E-GSM bands. The second lowest resonant mode of the first loop antenna 31 is used for the PCN1800 band or the PCS1900 band. The lowest resonant mode of the second loop antenna 32 is used for the other one of the PCN1800 band and the PCS1900 band.

Although the described antenna arrangement has a number of advantages such as its multi-band operation and reasonably compact design, it would be desirable to provide an alternative multi-band antenna arrangement, preferably with a more compact design.

BRIEF DESCRIPTION OF THE INVENTION

According to one embodiment of the invention there is provided an antenna arrangement comprising: a ground plane; a ground point connected to the ground plane; a feed point; a $\lambda/2$ antenna element connected to the ground point and to the feed point and extending between the ground point and the feed point as a loop that defines an area; and a $\lambda/4$ antenna element located within the area. The relative positioning of the antenna elements saves space.

According to another embodiment of the invention there is provided an antenna arrangement comprising: a ground plane; a ground point; a feed point; an unbalanced antenna element; a loop antenna element connected to the ground point and to the feed point and extending between the ground point and the feed point to surround the unbalanced antenna element. The relative positioning of the antenna elements saves space. The unbalanced antenna element may be a PIFA.

According to a further embodiment of the invention there is provided an antenna arrangement having multi-band operation over a frequency range and comprising: a ground plane; a ground point; a feed point; a $\lambda/2$ antenna element connected to the ground point and to the feed point and extending between the ground point and the feed point as a loop; and a $\lambda/4$ antenna element, wherein the $\lambda/2$ antenna element has two resonant modes in the frequency range covering at least first and second bands and the $\lambda/4$ antenna element has one resonant mode in the frequency range covering a third band.

The $\lambda/4$ antenna element may be sized to cover a low band or a high band. Multiple $\lambda/4$ antenna elements, of different sizes, may be used to cover a low band and a high band. The low band may be covered by a $\lambda/4$ antenna element that is indirectly fed from the $\lambda/2$ antenna element. The high band may be covered by a $\lambda/4$ antenna element that is directly fed via the feed point.

According to another embodiment of the invention there is provided an antenna arrangement, for multi-band operation over a frequency range, comprising: a ground plane; a ground point; a feed point; a $\lambda/2$ antenna element connected to the ground point and to the feed point and extending between the ground point and the feed point as a loop, the $\lambda/2$ antenna element having a lowest resonant mode that covers at least one of US-GSM and EGSM and a second lowest resonant mode in the frequency range that covers a first one of PCN1800 and PCS1900; and a $\lambda/4$ PIFA antenna element connected to the ground plane and the feed point, the $\lambda/4$ PIFA antenna element having a lowest resonant mode in the frequency range that covers a second one of PCN1800 and PCS1900.

The loop may circumscribe an area and the PIFA antenna element is located within the area to save space. The antenna arrangement may further comprise an additional $\lambda/4$ antenna element connected to the ground plane and indirectly fed from the $\lambda/2$ antenna element, the $\lambda/4$ antenna element having a lowest resonant mode that covers one of US-GSM or EGSM.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 2:
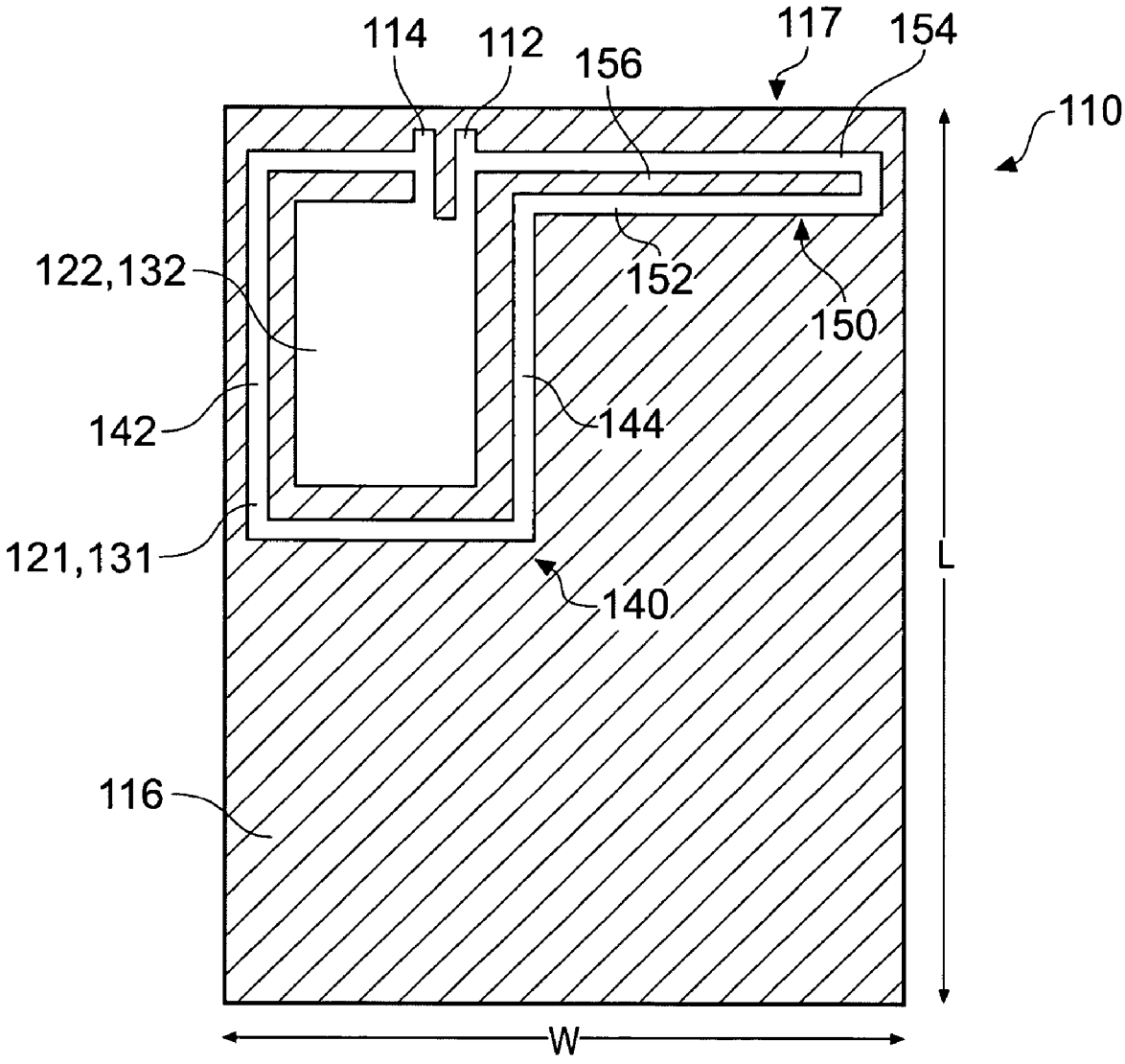
FIG. 2 schematically illustrates a new multi-band antenna arrangement.

A RF antenna arrangement 110 that enables a radio communication device to communicate in the multiple bands is schematically illustrated in FIG. 2.

The antenna arrangement 110 comprises: a feed point 112; a ground (short-circuit) point 114 connected to a ground plane 116; a first planar antenna element 121 extends between the feed point 112 and the ground point 114 to form a balanced loop antenna 131 of electrical length L1; and a second planar antenna element 122 is connected to the feed point 112 and the ground point 114 to form an unbalanced λ/4 antenna 132 of electrical length L2. The λ/4 antenna 132 is a planar inverted F antenna (PIFA). In other embodiments, the λ/4 antenna 32 may be a planar inverted L antenna (PILA) which is not directly connected to the feed point 112 but is instead indirectly fed via electromagnetic coupling provided by the loop antenna 131.

The first planar antenna element 121 is, for example, formed from a strip of metal foil and the second planar antenna element 122 is, for example, formed from a patch of metal foil. The first planar antenna element 121 and the second planar antenna element 122 are physically distinct and are separated by a gap.

The ground plane 116 may be a printed wiring board (PWB). In this example, it is of rectangular shape having a width Wand a length L. It is, in this example, parallel to the first and second planar elements 121, 122 but is displaced from them so that the first and second planar elements 121, 122 lie in a plane that is separated from the ground plane 116 by a distance H. In other embodiments the ground plane 116 is not parallel to the first and second planar elements 121, 122.

Figure 1:
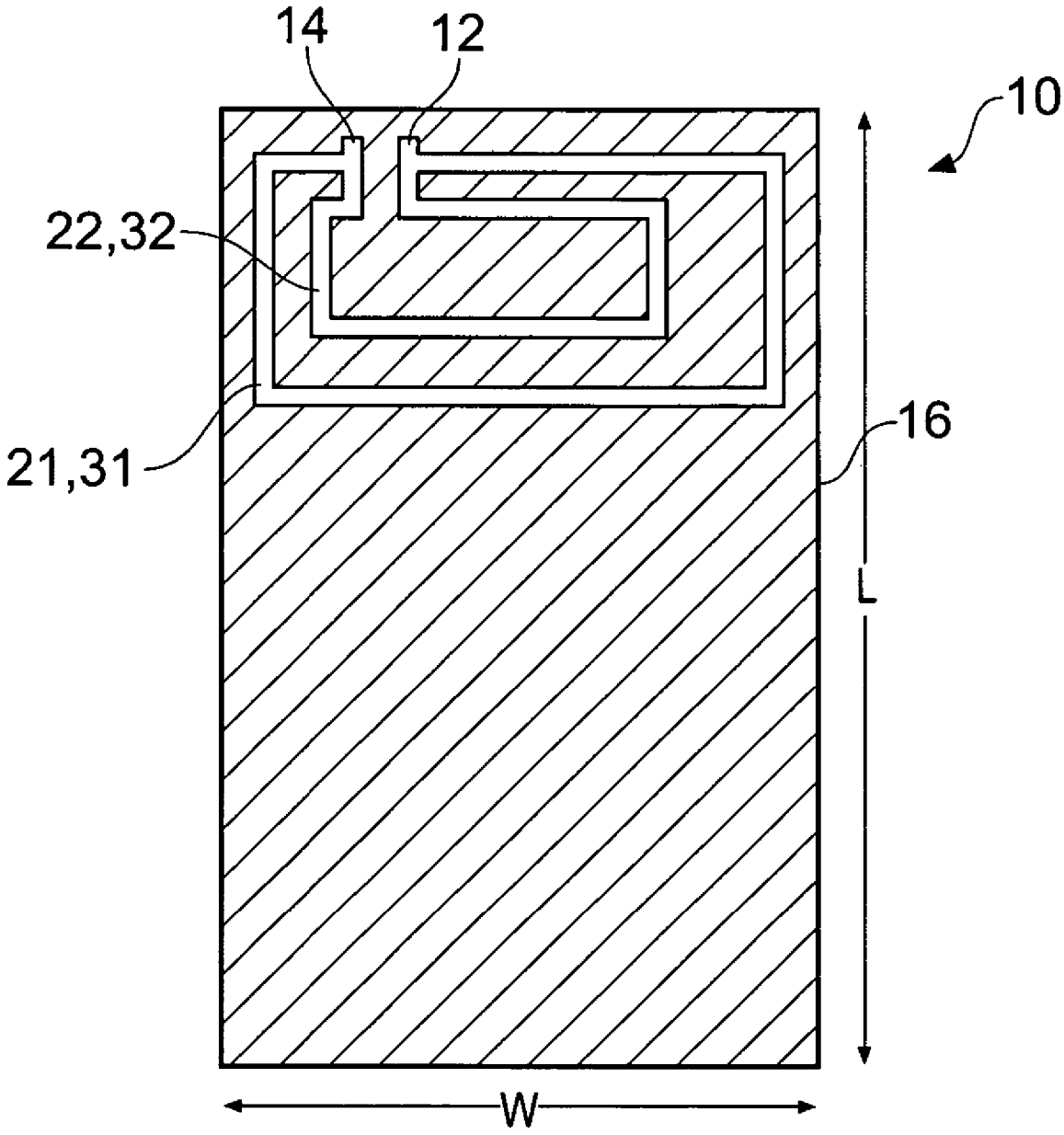
FIG. 1 schematically illustrates an existing multi-band antenna arrangement.

The loop antenna 131 has a lowest resonant mode at a frequency corresponding to λ/2=L1 and a second lowest resonant mode at a frequency corresponding to λ=L1. The λ/4 antenna 132 has a lowest resonant mode at a frequency corresponding to λ/4=L2. The electrical and physical length of the λ/4 antenna 132 is significantly less, approximately half that of the second loop antenna 32 illustrated in FIG. 1.

The bandwidth of the lowest resonant mode of the loop antenna 131 may be tuned by varying L and H. The lowest resonant mode of the loop antenna 131 is used either for one of the US-GSM and E-GSM bands or, if the bandwidth is tuned to a large value, by optimizing L and H, for both the US-GSM and E-GSM bands. The second lowest resonant mode of the loop antenna 131 is used for the PCN1800 band or the PCS1900 band. The lowest resonant mode of the λ/4 antenna 132 is used for the other one of the PCN1800 band and the PCS1900 band.

The lowest resonant mode of the loop antenna 131 covers the US-GSM and E-GSM bands when H is 7–9 mm and L is 95–130 mm. With these dimensions the return loss at each band is less than −6 dB. The antenna arrangement 110 is then a quad-band antenna.

To save space the second planar antenna element 122 lies inside the area circumscribed by the first planar antenna element 121. That is the loop antenna 131 surrounds the λ/4 antenna 132. This is particularly useful when the antenna arrangement 110 is used internally in a hand-portable radio communication device, such as a mobile cellular telephone.

In the design illustrated in FIG. 2, the loop antenna is formed from two U-bends arranged at right angles. The λ/4 antenna 132 lies within the first U bend 140 which is sized to snugly circumscribe the λ/4 antenna 132. The parallel limbs 142, 144 of the first U bend 140 are separated by a considerable distance compared to the width of the limbs 142, 144. The second U bend 150 is aligned parallel with a top edge 117 of the ground plane 116. The parallel limbs 152, 154 of the second U bend 150 are separated by a gap 156 of the order of the width of the limbs. This design minimizes the area circumscribed by the loop antenna 131 while still requiring it to circumscribe the λ/4 antenna 132.

It may not always be possible to tune L and H to achieve quad-band operation. This may occur for example if either L or H is constrained. L is constrained in, for example, hand-portable communication devices that have short PWBs. This may be because the communication device is a small volume device or may be because the communication device is a two part device in which the two parts move relative to each other, for example, by sliding or rotating.

Figure 3:
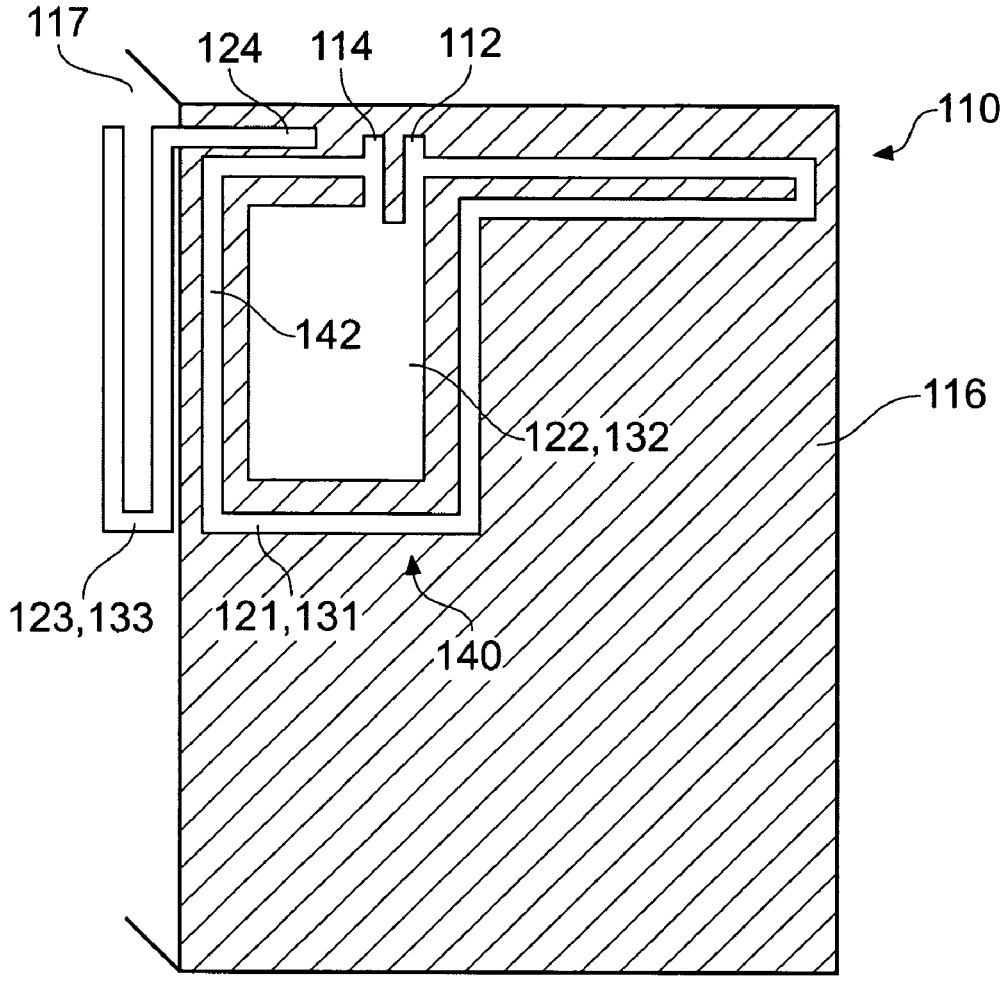
FIG. 3 schematically illustrates a new quad-band antenna arrangement.

Quad-band operation may, however, still be achieved by adapting the antenna arrangement 110 as illustrated in FIG. 3. The antenna arrangement 110 in FIG. 3 is the same as that illustrated in FIG. 2 except that it includes a third planar antenna element 123 which operates as a λ/4 antenna 133. In this example, the third planar antenna element 123 is connected to the ground plane 116, at point 124, but not to the feed point 112.

The third planar antenna element 123 is located in proximity to the loop antenna 131 in order that the loop antenna 131 may electromagnetically couple with the third planar antenna element 123 and act as an indirect feed for the λ/4 antenna 133. The λ/4 antenna 133 therefore operates as a PILA (parasitic PIFA).

The third planar antenna element 123 is typically a strip of metal that runs parallel to the first limb 142 of the first U bend 140 of the first antenna element 121. In the illustrated example, the strip of metal has the shape of a U bend, the limbs of which run parallel to the limbs of the first U-band of the first planar antenna element 121. The plane in which the third planar antenna element 123 lies may, however, be at an angle to the plane in which the first planar antenna element 121 lies. The angle may, as an example, be 90 degrees in which case the in which the third planar element lies may correspond to the side 117 of the ground plane 116.

The third planar antenna element 123 has an electrical length L3 and has a lowest resonant mode at a frequency corresponding to L3=λ/4. The value L3 can be tuned so that the lowest resonant mode covers the US-GSM band or the E-GSM bands.

The lowest resonant mode of the loop antenna 131 covers the US-GSM or E-GSM band. The λ/4 antenna 133 covers the US-GSM or E-GSM band not covered by the loop antenna 131.

The antenna arrangement 110 has two resonances at the low band: one generated by the loop antenna 131 and the other generated by the parasitic λ/4 antenna 133 whose high electrical field is located at the side edge 117 of the ground plane 116. The antenna arrangement 110 has a stable performance and is less influenced by its surroundings components and ground plane 116 length because of the high electrical field distribution and dual resonance feature.

Figure 4:
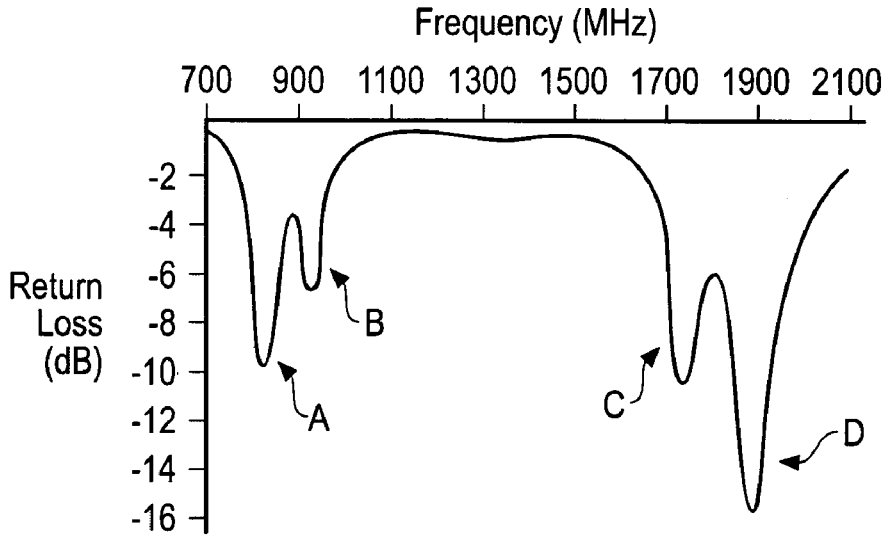
FIG. 4 schematically illustrates the return loss S11 for the quad-band antenna arrangement illustrated in FIG. 3.

FIG. 4 schematically illustrates the return loss S11 for the antenna arrangement 110 illustrated in FIG. 3. There are four resonance illustrated. The lowest frequency resonance which covers the US-GSM band is labeled A and is provided by the lowest resonant mode of the loop antenna 131. The second lowest frequency resonance which covers the EGSM band is labeled B and is provided by the parasitic λ/4 antenna 133. The third lowest frequency resonance which covers the PCN1800 band is labeled C and is provided by the PIFA λ/4 antenna 132. The fourth lowest frequency resonance which covers the PCS1900 band is labeled D and is provided by the second lowest resonant mode of the loop antenna 131.

Although the preceding description describes an implementation in which there is a loop antenna, a first λ/4 antenna 132 and a second λ/4 antenna 133, in other implementations the first λ/4 antenna 132 may not be present if it is not necessary to cover the PCN1800 band/PCS1900 band not covered by the loop antenna 131.

Although embodiments of the present invention have been described in the preceding paragraphs with reference to various examples, it should be appreciated that modifications to the examples given can be made without departing from the scope of the invention as claimed. For example, although the multi-band antenna arrangement 110 has been described with reference to the licensed cellular bands: US-GSM (824–894 MHz), E-GSM (880–960 MHz), PCN/DCS1800 (1710–1880 MHz), PCS1900 (1850–1990 MHz) with the lower band(s) being US-GSM and/or E-GSM and the upper bands being PCN/DCS1800 and PCS1900, the antenna arrangement 110 may operate in other bands such as licensed cellular bands US-WCDMA1900 (1850–1990); WCDMA21000 (Tx: 1920–19801 Rx: 2110–2180) and/or the unlicensed 2.4 GHz band used by Bluetooth and/or the bands used by WLAN or GPS, for example. As a non-limiting example, the two upper bands may be selected from PCN/DCS1800, PCS1900 and WCDMA2100 or from PCN/DCS1800, US-WCDMA1900 and WCDMA2100. As another non-limiting example, the two upper bands may be selected from the licensed cellular bands and/or unlicensed bands.

The invention claimed is:

1. An antenna arrangement comprising:

a ground plane;

a ground point connected to the ground plane;

a feed point;

a λ/2 antenna element connected to the ground point and to the feed point and extending between the ground point and the feed point as a loop that defines an area; and a λ/4 antenna element located within the area, wherein the λ/4 antenna element is a PIFA.

2. An antenna arrangement as claimed in claim 1, wherein the λ/4 antenna element is also connected to the ground point.

3. An antenna arrangement as claimed in claim 2, wherein the λ/4 antenna element is also connected to the feed point.

4. An antenna arrangement as claimed in claim 1, wherein the antenna arrangement is arranged for multi-band operation over a frequency range, the λ/2 antenna element having two resonant modes in the frequency range and the λ/4 antenna element having one resonant mode in the frequency range.

5. An antenna arrangement as claimed in claim 4, wherein the λ/2 antenna element has a lowest resonant mode and a second lowest resonant mode, wherein both the lowest resonant mode and the second lowest resonant mode are within the frequency range.

6. An antenna arrangement as claimed in claim 5, wherein lowest resonant mode of the λ/2 antenna element covers two bands.

7. An antenna arrangement as claimed in claim 5, wherein a length of the ground plane and/or a separation of the λ/2 antenna element from the ground plane is/are such that the lowest resonant mode covers two bands.

8. An antenna arrangement as claimed in claim 7, wherein the two bands are US-GSM and EGSM.

9. An antenna arrangement as claimed in claim 5, wherein the second lowest resonant mode covers one band.

10. An antenna arrangement as claimed in claim 9, wherein the one band is one of: PCN1800 and PCS1900.

11. An antenna arrangement as claimed in claim 4, wherein the λ/4 antenna element has a lowest resonant mode and the lowest resonant mode lies within the frequency range.

12. An antenna arrangement as claimed in claim 11, wherein the lowest resonant mode of the λ/4 antenna element covers one band.

13. An antenna arrangement as claimed in claim 12, wherein the one band is one of PCN1800 and PCS1900.

14. An antenna arrangement as claimed in claim 4, wherein the λ/2 antenna element has a lowest resonant mode and second lowest resonant mode, wherein both the lowest resonant mode and the second lowest resonant mode are within the frequency range and the lowest resonant mode covers one band.

15. An antenna arrangement as claimed in claim 14, wherein the one band is one of US-GSM and EGSM.

16. An antenna arrangement as claimed in claim 14, further comprising an additional λ/4 antenna element.

17. An antenna arrangement as claimed in claim 16, wherein the additional antenna element is connected to the ground plane and indirectly fed from the λ/2 antenna element.

18. An antenna arrangement as claimed in claim 17, wherein the additional λ/4 antenna element has a lowest resonant mode and the lowest resonant mode lies within the frequency range.

19. An antenna arrangement as claimed in claim 18, wherein the lowest resonant mode of the additional λ/4 antenna element covers one band.

20. An antenna arrangement as claimed in claim 19, wherein the one band is one of US-GSM or EGSM.

21. A communication device comprising an antenna arrangement as claimed in claim 1.

22. An antenna arrangement comprising:

a ground plane;

a ground point connected to the ground plane;

a feed point;

an unbalanced antenna element, where the unbalanced antenna element is a PIFA antenna;

a balanced antenna element connected to the ground point and to the feed point and extending between the ground point and the feed point to surround the unbalanced antenna element.

23. An antenna arrangement having multi-band operation over a frequency range and comprising:

a ground plane;

a ground point connected to the ground plane;

a feed point;

a λ/2 antenna element connected to the ground point and to the feed point and extending between the ground point and the feed point as a loop; and a λ/4 antenna element, wherein the λ/2 antenna element has two resonant modes in the frequency range covering at least first and second bands and the λ/4 antenna element has one resonant mode in the frequency range covering a third band.

24. An antenna arrangement as claimed in claim 23, having quad band operation, wherein the λ/4 antenna element is sized to have a lowest resonant mode that covers one of the two lowest frequency bands.

25. An antenna arrangement as claimed in claim 23, wherein the λ/4 antenna element is sized to have a lowest resonant mode that covers one of US-GSM or EGSM.

26. An antenna arrangement as claimed in claim 23, wherein the λ/4 antenna element is sized to have a lowest resonant mode that covers one of PCN1800 or PCS1900.

27. A communications device comprising an antenna arrangement as claimed in claim 23.

28. A communications device as claimed in claim 27 comprising a first part and a second part wherein the first and second parts move relative to one another and the antenna arrangement is located in the first part.

29. An antenna arrangement, for multi-band operation over a frequency range, comprising:

a ground plane;

a ground point connected to the ground plane;

a feed point;

a λ/2 antenna element connected to the ground point and to the feed point and extending between the ground point and the feed point as a loop, the λ/2 antenna element having a lowest resonant mode that covers at least one of US-GSM and EGSM bands and a second lowest resonant mode in the frequency range that covers a first one of PCN1800 and PCS1900 bands; and a PIFA antenna element connected to the ground plane and the feed point, the PIFA antenna element having a lowest resonant mode in the frequency range that covers a second one of PCN1800 and PCS1900.

30. An antenna arrangement as claimed in claim 29, wherein the loop circumscribes an area and the PIFA antenna element is located within the area.

31. An antenna arrangement as claimed in claim 29, further comprising a λ/4 antenna element connected to the ground plane and indirectly fed from the λ/2 antenna element, the λ/4 antenna element having a lowest resonant mode that covers one of US-GSM or EGSM.

32. An antenna arrangement comprising:

a ground plane;

a ground point connected to the ground plane;

a feed point; a λ/2 antenna element connected to the ground point and to the feed point and extending between the ground point and the feed point as a loop that defines an area; and a λ/4 antenna element located within the area, wherein the λ/4 antenna element is a planar inverted L antenna.

* * * * *